United States Patent [19]

Pontius et al.

[11] Patent Number: 4,518,401

[45] Date of Patent: May 21, 1985

[54] ELECTROSTATIC PRECIPITATING SYSTEM

[75] Inventors: Duane H. Pontius, Birmingham; Phillip V. Bush, Pinson, both of Ala.

[73] Assignee: The United States of America as represented by the Environmental Protection Agency, Washington, D.C.

[21] Appl. No.: 535,643

[22] Filed: Sep. 26, 1983

[51] Int. Cl.[3] ..... B03C 3/08

[52] U.S. Cl. ..... 55/101; 55/150; 55/2

[58] Field of Search ..... 55/2, 101, 137, 139, 55/150, 151

[56] References Cited

U.S. PATENT DOCUMENTS

| | | | |
|---|---|---|---|
| 1,425,637 | 8/1922 | Eschholz | 55/137 |
| 3,763,632 | 10/1975 | Imris | 55/150 |
| 3,819,985 | 6/1974 | Dusevoir | 55/151 |
| 3,915,672 | 10/1975 | Penney | 55/137 |
| 4,071,688 | 1/1978 | Lynch et al. | 55/150 |

FOREIGN PATENT DOCUMENTS

| | | | |
|---|---|---|---|
| 413800 | 7/1934 | United Kingdom | 55/150 |

*Primary Examiner*—David L. Lacey

[57] ABSTRACT

An electrostatic precipitator for the removal of dust having a resistivity of from $10^9$ to $5\times10^{12}$ ohm cm from a gas wherein negatively biased discharge rods are arranged in a plane between grounded plates, and wherein the rods are of a diameter of approximately $\frac{3}{8}$" (approximately 0.375 inch) enabling increased level of electrical field to be employed without the problem of back corona discharge.

3 Claims, 2 Drawing Figures

ELECTROSTATIC PRECIPITATING SYSTEM

This invention was made in the performance of work for the Environmental Protection Agency under EPA Contract No. 68-02-2683.

TECHNICAL FIELD

This invention relates generally to electrostatic precipitators for removal of dust, e.g., flyash, from gases being released into the atmosphere, and particularly to the sizing of discharge rods and field strengths employed in electrostatic precipitators.

BACKGROUND OF THE INVENTION

Electrostatic precipitators are employed for the removal of particles in various gases, particularly from smoke emanating from coal fired boilers employed in the generation of electrical power. Typically, a precipitator includes a series of electrical precipitating sections arranged to serially intercept smoke, each stage employing a plurality of parallel, vertically positioned, metal plates and between each two there is positioned spaced strands of wire lying in a plane halfway between and parallel with the plates. The wire is typically no greater in diameter than $\frac{1}{8}''$, and, in some instances, barbs, like barb wire, are attached to the wire. The wires are negatively biased with respect to the plates, which are grounded, there being a potential difference between wires and plates in the kilovolt range such that current densities are produced on the order of 10 to 50 nanoamperes per square cm (centimeter). When properly so biased, corona discharge occurs from the wires into adjacent spaces containing particles, causing them to be negatively charged. The particles are then drawn by the electrical field to the positively poled plates. Then, periodically, the plates are mechanically rapped, and the particles fall off and are collected.

One problem that is ever present with precipitators of the class described is that of the possible occurrence of what is termed back corona discharge, or corona discharged from dust layers accumulated on the plates. When this occurs, positively charged particles are produced, and they thus tend to flow away from the plates and neutralize the effect of normal negatively charged particle flow to the plates. This degrades the performance of the precipitator.

Back corona discharges arise when the normal ion current from the discharge wire element increases beyond a selected level, normally referred to as a maximum permissible current density level. Practically, this means that the bias between the wire discharge element and plates, and thus field strength must be restricted to a value which will not produce a current density in excess of the maximum permissible current density. Significantly, this maximum permissible current density level is inversely proportional to the resistivity of the particles to be precipitated out.

In the past, where coal fired boilers typically burned high sulfur coal, resistivities were on the order of $10^9$ to $5\times10^{10}$ ohm cm, and in such case, current densities on the order of 20 to 60 nanoamperes per square cm (obtained by field strengths on the order of 1.5 to 3.5 kilovolts per cm) were permissible without back corona discharge and good results were obtainable. In recent years, however, because of the increased emphasis on protection of the environment, there has been, and there is now occurring, a substantial shift to the employment of low sulfur coal, and low sulfur coal typically produces particles having an increased resistivity, typically in the range of $5\times10^{10}$ to $5\times10^{12}$ ohm cm. This in turn creates the problem suggested, namely, that in order to operate with existing systems (and without back corona discharge) it is necessary to reduce field strengths (by reduction of applied bias) to reduce current densities. In fact, it has been found with existing systems that to avoid back corona, current densities must be reduced to typically less than 10 nanoamperes per square cm. This calls for rather severe decreases in field strength. This in turn necessarily decreases the charge imparted to particles, and the combination of reduced field strength and reduced particle charge decreases the velocity of movement of particles, and in general the efficiency of particle collection. Thus, less collection is effected for a given cross section of precipitator.

It is the object of this invention to solve the problem described and to accomplish it by a system in which the actual field strength is increased rather than decreased, obviously a desired state as indicated above.

SUMMARY OF THE INVENTION

In accordance with the present invention, a gaseous fluid, such as smoke, having particles with increased resisitivity, for example, extending upward to the range of from $5\times10^{10}$ to $5\times10^{12}$ ohm cm would be fed through a precipitator in which instead of barbed wire or even wire (typically having a diameter of $\frac{1}{8}''$) as discharged electrodes, the discharge electrodes are, for example constructed of rods, and these would have a curvature in effective regions of discharge of approximately 3/16", or an effective diameter of $\frac{3}{8}''$. This is approximately three times the size of previously employed discharge electrodes. Thus, for example, a $\frac{3}{8}''$ circular rod would be employed instead of a $\frac{1}{8}''$ circular wire. By this system, it has been found that electrical fields can be materially increased, and at the same time current densities decreased. As a result, it has been found that the problem of back corona discharge which had been encountered has been solved, enabling the effective and efficient removal of high resistivity particles in smoke products resulting from the burning of low sulfur coal.

DETAILED DESCRIPTION OF THE DRAWINGS

Figures 1, 2:
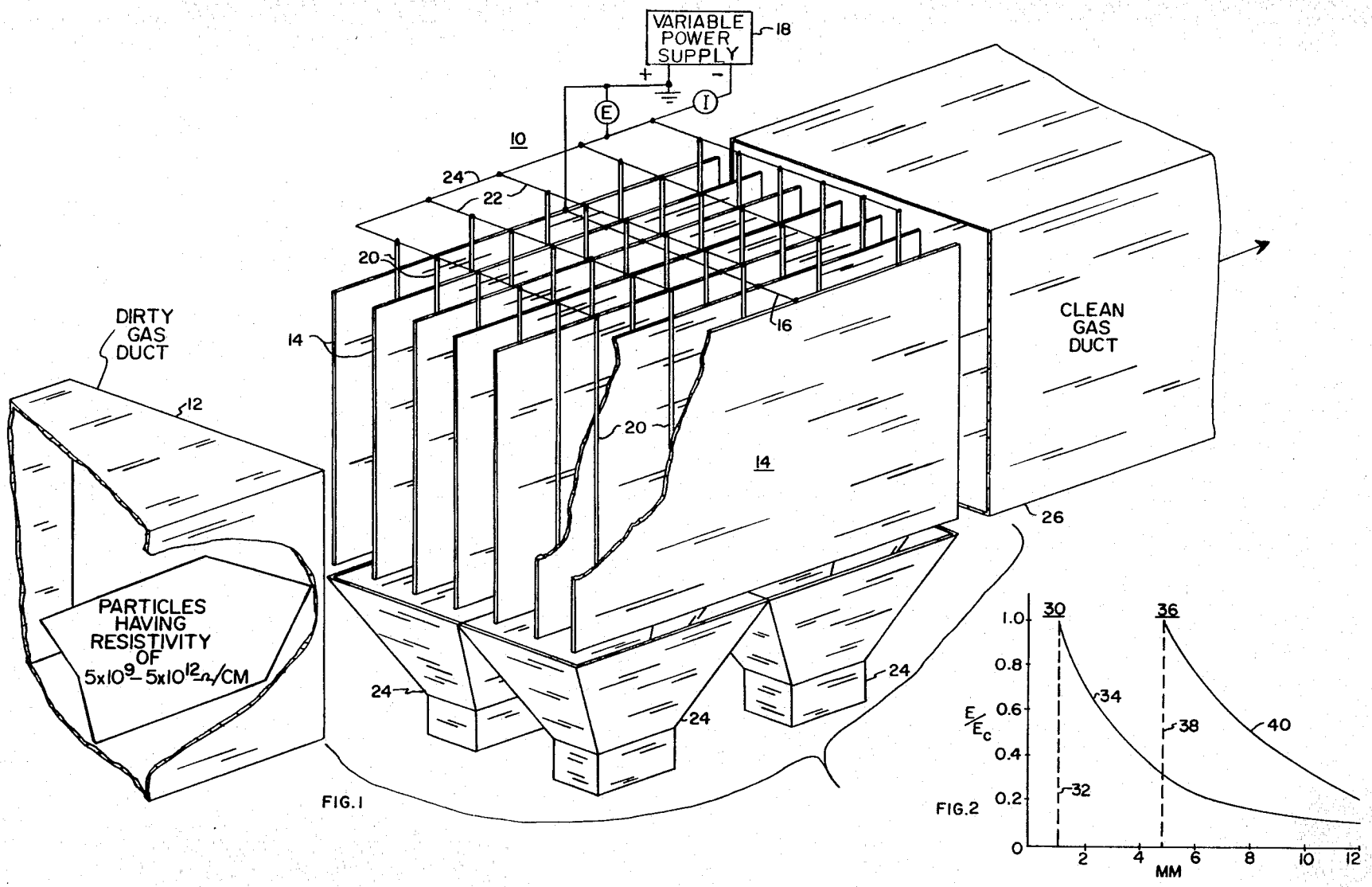
FIG. 1 is a diagrammatic illustration of the system of this invention.
FIG. 2 is a graph illustrating the ratio of field strength to critical field strength (that required to produce corona discharge) calculated as a function of position near discharge electrodes in a fixed geometry for electrodes as contemplated by this invention and previous, smaller size, electrodes.

Referring initially to FIG. 1, there is shown a precipitator assembly 10 which is fed, from duct 12, a dirty gas, or smoke, having particles with a relatively high resistivity of from $5\times10^{10}$ to $5\times10^{12}$ ohm cm. This gas would typically be a combustion product of a coal fired boiler burning coal with a low sulfur content of from less than 1% to 2%, by weight. Precipitator assembly 10 is conventional in configuration, having a plurality of metal plates 14, typically being separated 9" to 20" and typically having a width of 12' (per section) and a height of 40'. Plates 14 are connected together via an electrical conductor 16 and are connected to ground and to the positive terminal of a variable, D.C. 20 to 50 kilovolts, power supply 18.

A series of conductive rods 20 are spaced, with respect to each other, approximately 4.5" to 12" within a plane which is mid way between plates 14. Rods 20 have no point contacts on them, such as barbs, and are not less than approximately ⅜" in diameter, or 0.187" in radius. As stated above, radius figures relate to the curvatures of rods in effective regions of discharge. These regions are regions facing plates 14. Rows of rods 20 are connected by a wire conductor 22 to a conductive wire bus 24 which in turn is connected to the negative terminal of power supply 18. Plates 14 and rods 20 are supported in the position shown by means not shown. Significantly, rods 20 are held by insulating supports, whereas plates 14 may be simply connected to a grounded supporting structure, not shown.

Hoppers 24 are positioned under precipitators assembly 10 and serve to catch particles which have been trapped by plates 14. This function is enabled by rapping the plates, causing particles to drop into the hoppers. Gases cleaned by precipitator assembly 10 flow outward through clean gas duct 26 and would then typically be fed upward through a smoke stack for ultimate discharge.

Typically, precipitator assembly 10 would actually be one of several precipitator stages arranged to intercept the gas to be cleaned.

In operation, variable power supply 18 would typically be operated on, and "dirty" gas would be fed from duct 12 through precipitator assembly 10. Power supply 18 would be adjusted to a voltage, registered on volt meter E, to produce a current registered on milliampere meter I that would result in a current to produce a computed current density on the order of 1 nanoampere per square cm (in a range of from 0.5 to 10 nanoamperes per square cm), a substantial reduction over current practice. This would be computed by dividing the measured current indicated by milliampere meter I by the area of the plates.

FIG. 2 illustrates the improvement achieved by the employment of the increased diameter sized rods as a discharge electrode over that obtained by conventional employment of a smaller, or wire, conductor as a discharge electrode. Curve 30 illustrates by the dashed line 32 the surface position of a conventional 0.1" wire, the center being at the 0 point. As noted, portion 34 illustrates the ratio of field strength to critical field strength (the field at which corona commences) for a discrete distance extending outward from the surface of the electrode. Similarly, curve 36 illustrates the same ratio as it would persist outward from the surface of a 0.375" electrode for that electrode, wherein dashed line 38 indicates the position of the surface of the electrode, and portion 40 illustrates the ratio of field strength to critical field strength. As indicated by the bias potentials 13.2 kilovolts bias for the small electrode and 35.3 kilovolts for the larger electrode and the relative elevations of the curves, it is to be noted that a larger average field strength is permissible for the larger electrode, thus indicating a significantly improved operating state.

The curves illustrated in FIG. 2 are computed in accordance with classical equations, one reference to them being a paper by P. Cooperman entitled "A Theory For Space Charge Limited Currents With Applications To Electrical Precipitation," published in the March 1960 issue of the *AIEE Journal.*

From the foregoing, it is to be appreciated that the present invention solves the problem of effective precipitation of the high resistivity particles typically occurring with the burning of low sulfur coal. Significantly, and importantly for the entire field of particle precipitation, the invention indicates that, in general, enhanced results can be achieved by its system of employing discharge electrodes on the order of three times larger in diameter than previously employed and, by the application of field strengths, 20% to 60% larger as previously employed, and yet yielding substantially decreased current densities.

What is claimed is:

1. An electrostatic precipitating system comprising:

a source of gaseous field containing spaced particles, said particles having a resistivity of from $10^9$ to $5\times10^{12}$ ohm cm;

an electrostatic precipatating assembly having an inlet coupled to receive gaseous fluid from said source of gaseous fluid and an outlet, and comprising:

a plurality of parallel positioned plates having a spacing of from 9" to 20" and oriented wherein said gaseous fluid flows between said plates from said inlet to said outlet, and a plurality of electrically conductive rods positioned in a plane equally spaced between each pair of plates, and rods having curved cross section regions facing plates of a radius of curvature not less than approximately 0.187"; and a source of D.C. bias of from 20 to 50 kilovolts, the negative potential of which is connected to said rods, and the positive potential of which is connected to said plates of a potential providing an electrical field strength of from 0.5 to 3.5 kilovolts per cm and a current density of 0.5 to 10 nanoamperes per square cm;

whereby said gaseous field transisting from said inlet to said outlet are subjected to an electrical field between said rods and said plates, and corona discharge from said rods effects a negative charge on said particles in said gas, which said particles are then drawn to said plates and thereby removed from the gaseous fluid.

2. A precipitating system as set forth in claim 1 wherein said particles have a resistivity of $5\times10^{10}$ to $5\times10^{12}$ ohm cm.

3. A precipitating system as set forth in claim 1 wherein said rods are circular.

* * * * *